US008714121B2

(12) United States Patent
Phillips et al.

(10) Patent No.: US 8,714,121 B2
(45) Date of Patent: May 6, 2014

(54) SPLIT-CYCLE AIR HYBRID V-ENGINE

(75) Inventors: Ford Allen Phillips, San Antonio, TX (US); Stephen P. Scuderi, West Springfield, MA (US); Douglas Arthur McKee, Helotes, TX (US)

(73) Assignee: Scuderi Group, Inc., West Springfield, MA (US)

( * ) Notice: Subject to any disclaimer, the term of this patent is extended or adjusted under 35 U.S.C. 154(b) by 291 days.

(21) Appl. No.: 13/248,059

(22) Filed: Sep. 29, 2011

(65) Prior Publication Data

US 2012/0080017 A1 Apr. 5, 2012

Related U.S. Application Data

(60) Provisional application No. 61/388,716, filed on Oct. 1, 2010.

(51) Int. Cl.
*F02B 33/00* (2006.01)
*F02M 15/00* (2006.01)

(52) U.S. Cl.
USPC ..... 123/68; 123/70 R; 123/542

(58) Field of Classification Search
USPC ..... 123/68, 70 R, 542, 543, 556
See application file for complete search history.

(56) References Cited

U.S. PATENT DOCUMENTS

| | | | |
|---|---|---|---|
| 1,936,653 | A | 11/1933 | Almen |
| 2,058,705 | A | 10/1936 | Maniscalo |
| 2,109,809 | A | 3/1938 | Van Ranst |
| 2,394,354 | A | 2/1946 | Barr |
| 2,772,667 | A | 12/1956 | Nallinger |
| 3,209,737 | A | 10/1965 | Isao |
| 3,774,581 | A | 11/1973 | Lundy |
| 3,786,792 | A | 1/1974 | Pelizzoni et al. |
| 3,808,818 | A | 5/1974 | Cataldo |
| 3,880,126 | A | 4/1975 | Thurston et al. |
| 3,908,701 | A | 9/1975 | Dawawala |
| 3,938,483 | A | 2/1976 | Firey |
| 3,949,964 | A | 4/1976 | Freeman |
| 4,133,172 | A | 1/1979 | Cataldo |

(Continued)

FOREIGN PATENT DOCUMENTS

| | | | |
|---|---|---|---|
| DE | 10115967 | A1 | 10/2002 |
| GB | 2250801 | A | 6/1992 |

(Continued)

OTHER PUBLICATIONS

Meldolesi, et al. (Southwest Research Institute), Scuderi Split Cycle Fast Acting Valvetrain: Architecture and Development, SAE paper 2011-01-0404 (Jan. 18, 2011) (23 pages).

(Continued)

*Primary Examiner* — Noah Kamen
(74) *Attorney, Agent, or Firm* — Nutter McClennen & Fish LLP; John J. Penny, Jr.; Michael P. Visconti, III

(57) ABSTRACT

A split-cycle air hybrid engine with improved efficiency is disclosed in which the centerline of a compression cylinder is positioned at a non-zero angle with respect to the centerline of an expansion cylinder such that the engine has a V-shaped configuration. In one embodiment, the centerlines of the respective cylinders intersect an axis parallel to, but offset from, the axis of rotation of the crankshaft. Modular cross-over passages, crossover passage manifolds, and associated air reservoir valve assemblies and thermal regulation systems are also disclosed.

15 Claims, 12 Drawing Sheets

(56) References Cited

U.S. PATENT DOCUMENTS

| | | | |
|---|---|---|---|
| 4,224,798 | A | 9/1980 | Brinkerhoff |
| 4,307,687 | A | 12/1981 | Holstein |
| 4,344,405 | A | 8/1982 | Zaharis |
| 4,418,657 | A | 12/1983 | Wishart |
| 4,825,717 | A | 5/1989 | Mills |
| 4,860,716 | A | 8/1989 | Deutschmann |
| 4,934,652 | A | 6/1990 | Golden |
| 5,018,487 | A | 5/1991 | Shinkai |
| 5,193,495 | A | 3/1993 | Wood, III |
| 5,402,756 | A | 4/1995 | Bohme et al. |
| 5,555,861 | A | 9/1996 | Mayr et al. |
| 5,690,066 | A | 11/1997 | Hampton et al. |
| 5,713,316 | A | 2/1998 | Sturman |
| 5,964,087 | A | 10/1999 | Tort-Oropeza |
| 5,988,124 | A | 11/1999 | Duesmann |
| 6,152,714 | A | 11/2000 | Mitsuya et al. |
| 6,192,841 | B1 | 2/2001 | Vorih et al. |
| 6,230,472 | B1 | 5/2001 | Stahlecker |
| 6,230,742 | B1 | 5/2001 | Bircann |
| 6,273,057 | B1 | 8/2001 | Schwoerer et al. |
| 6,302,370 | B1 | 10/2001 | Schwoerer et al. |
| 6,332,917 | B1 | 12/2001 | Schollkopf |
| 6,334,435 | B1 | 1/2002 | Negre et al. |
| 6,397,579 | B1 | 6/2002 | Negre |
| 6,412,457 | B1 | 7/2002 | Vorih et al. |
| 6,474,277 | B1 | 11/2002 | Vanderpoel et al. |
| 6,510,824 | B2 | 1/2003 | Vorih et al. |
| 6,543,225 | B2 | 4/2003 | Scuderi |
| 6,584,885 | B2 | 7/2003 | Lou |
| 6,609,371 | B2 | 8/2003 | Scuderi |
| 6,647,954 | B2 | 11/2003 | Yang et al. |
| 6,655,327 | B1 | 12/2003 | Hedman |
| 6,874,453 | B2 | 4/2005 | Coney et al. |
| 6,883,775 | B2 | 4/2005 | Coney et al. |
| 6,952,923 | B2 | 10/2005 | Branyon et al. |
| 7,140,332 | B2 | 11/2006 | Klein et al. |
| 7,156,062 | B2 | 1/2007 | Vanderpoel |
| 7,171,930 | B2 | 2/2007 | Keel |
| 7,353,786 | B2 | 4/2008 | Scuderi et al. |
| 7,481,190 | B2 | 1/2009 | Scuderi |
| 7,513,224 | B2 | 4/2009 | Heaton |
| 7,536,984 | B2 | 5/2009 | Lou |
| 7,603,970 | B2 | 10/2009 | Scuderi et al. |
| 7,628,126 | B2 | 12/2009 | Scuderi |
| 7,637,234 | B2 | 12/2009 | Tussing et al. |
| 7,690,337 | B2 | 4/2010 | Pirault et al. |
| 7,810,459 | B2 | 10/2010 | Branyon et al. |
| 7,823,547 | B2 | 11/2010 | Forner, Sr. et al. |
| 7,963,259 | B2 | 6/2011 | Meldolesi et al. |
| 2002/0185091 | A1 | 12/2002 | Vorih et al. |
| 2005/0022768 | A1 | 2/2005 | Tores et al. |
| 2005/0132987 | A1 | 6/2005 | Chang |
| 2005/0268609 | A1 | 12/2005 | Branyon et al. |
| 2006/0124085 | A1 | 6/2006 | Luttgeharm |
| 2006/0273271 | A1 | 12/2006 | Yang et al. |
| 2007/0157894 | A1 | 7/2007 | Scuderi et al. |
| 2008/0054205 | A1 | 3/2008 | Lou |
| 2008/0202454 | A1 | 8/2008 | Pirault |
| 2008/0251041 | A1 | 10/2008 | Lou |
| 2009/0038596 | A1 | 2/2009 | Pirault et al. |
| 2009/0038598 | A1 | 2/2009 | Phillips |
| 2009/0044778 | A1 | 2/2009 | Scuderi et al. |
| 2009/0133648 | A1 | 5/2009 | Lou |
| 2010/0126442 | A1 | 5/2010 | Lou |
| 2010/0180847 | A1 | 7/2010 | Meldolesi et al. |
| 2010/0180848 | A1 | 7/2010 | Meldolesi et al. |
| 2010/0263646 | A1 | 10/2010 | Giannini et al. |
| 2010/0282225 | A1 | 11/2010 | Gilbert et al. |
| 2010/0300385 | A1 | 12/2010 | Durrett et al. |

FOREIGN PATENT DOCUMENTS

| | | | |
|---|---|---|---|
| GB | 2340881 | A | 3/2000 |
| JP | 40-010860 | A | 4/1965 |
| JP | 10-274105 | A | 10/1998 |
| JP | 2004-293695 | A | 10/2004 |
| WO | 2006094213 | A1 | 9/2006 |

OTHER PUBLICATIONS

Phillips, et al. (Southwest Research Institute), Scuderi Split Cycle Research Engine: Overview, Architecture and Operation, SAE paper 2011-01-0403 (Jan. 18, 2011) (21 pages).

Urata, et al. (Honda), A Study of Vehicle Equipped with Non-Throttling S.I. Engine with Early Intake Valve Closing Mechanism, SAE paper 930820 (Mar. 1, 1993) (13 pages).

International Search Report and Written Opinion, PCT/US2011/053802, dated Feb. 14, 2012 (13 pages).

SPLIT-CYCLE AIR HYBRID V-ENGINE

CROSS-REFERENCE TO RELATED APPLICATIONS

This application claims the benefit of priority of U.S. Provisional Patent Application No. 61/388,716, filed on Oct. 1, 2010, the entire contents of which are incorporated herein by reference.

FIELD

The present invention relates to split-cycle engines and in particular to split-cycle air hybrid engines having a V-shaped configuration.

BACKGROUND

For purposes of clarity, the term "conventional engine" as used in the present application refers to an internal combustion engine wherein all four strokes of the well-known Otto cycle (i.e., the intake, compression, expansion and exhaust strokes) are contained in each piston/cylinder combination of the engine. Also, for purposes of clarity, the following definition is offered for the term "split-cycle engine" as may be applied to engines disclosed in the prior art and as referred to in the present application.

A split-cycle engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

U.S. Pat. No. 6,543,225 granted Apr. 8, 2003 to Scuderi and U.S. Pat. No. 6,952,923 granted Oct. 11, 2005 to Branyon et al., both of which are incorporated herein by reference, contain an extensive discussion of split-cycle and similar-type engines. In addition, these patents disclose details of prior versions of an engine of which the present disclosure details further developments.

Split-cycle air hybrid engines combine a split-cycle engine with an air reservoir and various controls. This combination enables a split-cycle air hybrid engine to store energy in the form of compressed air in the air reservoir. The compressed air in the air reservoir is later used in the expansion cylinder to power the crankshaft.

A split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

U.S. Pat. No. 7,353,786 granted Apr. 8, 2008 to Scuderi et al., which is incorporated herein by reference, contains an extensive discussion of split-cycle air hybrid and similar-type engines. In addition, this patent discloses details of prior hybrid systems of which the present disclosure details further developments.

Referring to FIG. 1, an exemplary prior art split-cycle air hybrid engine is shown generally by numeral 10. The split-cycle air hybrid engine 10 replaces two adjacent cylinders of a conventional engine with a combination of one compression cylinder 12 and one expansion cylinder 14. The four strokes of the Otto cycle are "split" over the two cylinders 12 and 14 such that the compression cylinder 12, together with its associated compression piston 20, perform the intake and compression strokes, and the expansion cylinder 14, together with its associated expansion piston 30, perform the expansion and exhaust strokes. The Otto cycle is therefore completed in these two cylinders 12, 14 once per crankshaft 16 revolution (360 degrees CA) about crankshaft axis 17.

During the intake stroke, intake air is drawn into the compression cylinder 12 through an intake port 19 disposed in the cylinder head 33. An inwardly-opening (opening inward into the cylinder and toward the piston) poppet intake valve 18 controls fluid communication between the intake port 19 and the compression cylinder 12.

During the compression stroke, the compression piston 20 pressurizes the air charge and drives the air charge into the crossover passage (or port) 22, which is typically disposed in the cylinder head 33. This means that the compression cylinder 12 and compression piston 20 are a source of high pressure gas to the crossover passage 22, which acts as the intake passage for the expansion cylinder 14. In some embodiments two or more crossover passages 22 interconnect the compression cylinder 12 and the expansion cylinder 14.

The volumetric (or geometric) compression ratio of the compression cylinder 12 of the split-cycle engine 10 (and for split-cycle engines in general) is herein referred to as the "compression ratio" of the split-cycle engine. The volumetric (or geometric) compression ratio of the expansion cylinder 14 of the split-cycle engine 10 (and for split-cycle engines in general) is herein referred to as the "expansion ratio" of the split-cycle engine. The volumetric compression ratio of a cylinder is well known in the art as the ratio of the enclosed (or trapped) volume in the cylinder (including all recesses) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high volumetric compression ratios (e.g., 20 to 1, 30 to 1, 40 to 1, or greater) within the compression cylinder 12, an outwardly-opening (opening outwardly away from the cylinder and piston) poppet crossover compression (XovrC) valve 24 at the crossover passage inlet 25 is used to control flow from the compression cylinder 12 into the crossover passage 22. Due to very high volumetric compression ratios (e.g., 20 to 1, 30 to 1, 40 to 1, or greater) within the expansion cylinder 14, an outwardly-opening poppet crossover expansion (XovrE) valve 26 at the outlet 27 of the crossover passage 22 controls flow from the crossover passage 22 into the expansion cylinder 14. The actuation rates and phasing of the XovrC and XovrE valves 24, 26 are timed to maintain pressure in the crossover passage 22 at a high minimum pressure (typically 20 bar or higher at full load) during all four strokes of the Otto cycle.

At least one fuel injector 28 injects fuel into the pressurized air at the exit end of the crossover passage 22 in correspondence with the XovrE valve 26 opening, which occurs shortly before the expansion piston 30 reaches its top dead center position. The air/fuel charge enters the expansion cylinder 14 shortly after the expansion piston 30 reaches its top dead center position. As the piston 30 begins its descent from its top dead center position, and while the XovrE valve 26 is still open, a spark plug 32, which includes a spark plug tip 39 that protrudes into the cylinder 14, is fired to initiate combustion in the region around the spark plug tip 39. Combustion is initiated while the expansion piston is between 1 and 30 degrees CA past its top dead center (TDC) position. More preferably, combustion is initiated while the expansion piston is between 5 and 25 degrees CA past its top dead center (TDC) position. Most preferably, combustion is initiated while the expansion piston is between 10 and 20 degrees CA past its top dead center (TDC) position. Additionally, combustion may be initiated through other ignition devices and/or methods, such as with glow plugs, microwave ignition devices, or through compression ignition methods.

During the exhaust stroke, exhaust gases are pumped out of the expansion cylinder 14 through an exhaust port 35 disposed in the cylinder head 33. An inwardly-opening poppet exhaust valve 34, disposed in the inlet 31 of the exhaust port 35, controls fluid communication between the expansion cylinder 14 and the exhaust port 35. The exhaust valve 34 and the exhaust port 35 are separate from the crossover passage 22. That is, the exhaust valve 34 and the exhaust port 35 do not make contact with the crossover passage 22.

With the split-cycle engine concept, the geometric engine parameters (i.e., bore, stroke, connecting rod length, volumetric compression ratio, etc.) of the compression and expansion cylinders 12, 14 are generally independent from one another. For example, the crank throws 36, 38 for the compression cylinder 12 and the expansion cylinder 14, respectively, may have different radii and may be phased apart from one another such that top dead center (TDC) of the expansion piston 30 occurs prior to TDC of the compression piston 20. This independence enables the split-cycle engine 10 to potentially achieve higher efficiency levels and greater torques than typical four-stroke engines.

The geometric independence of engine parameters in the split-cycle engine 10 is also one of the main reasons why pressure is maintained in the crossover passage 22 as discussed earlier. Specifically, the expansion piston 30 reaches its top dead center position prior to the compression piston reaching its top dead center position by a discreet phase angle (typically between 10 and 30 crank angle degrees). This phase angle, together with proper timing of the XovrC valve 24 and the XovrE valve 26, enables the split-cycle engine 10 to maintain pressure in the crossover passage 22 at a high minimum pressure (typically 20 bar absolute or higher during full load operation) during all four strokes of its pressure/volume cycle. That is, the split-cycle engine 10 is operable to time the XovrC valve 24 and the XovrE valve 26 such that the XovrC and XovrE valves are both open for a substantial period of time (or period of crankshaft rotation) during which the expansion piston 30 descends from its TDC position towards its BDC position and the compression piston 20 simultaneously ascends from its BDC position towards its TDC position. During the period of time (or crankshaft rotation) that the crossover valves 24, 26 are both open, a substantially equal mass of gas is transferred (1) from the compression cylinder 12 into the crossover passage 22 and (2) from the crossover passage 22 to the expansion cylinder 14. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 90% of the entire intake and exhaust strokes or greater), the XovrC valve 24 and XovrE valve 26 are both closed to maintain the mass of trapped gas in the crossover passage 22 at a substantially constant level. As a result, the pressure in the crossover passage 22 is maintained at a predetermined minimum pressure during all four strokes of the engine's pressure/volume cycle.

For purposes herein, the method of opening the XovrC 24 and XovrE 26 valves while the expansion piston 30 is descending from TDC and the compression piston 20 is ascending toward TDC in order to simultaneously transfer a substantially equal mass of gas into and out of the crossover passage 22 is referred to herein as the Push-Pull method of gas transfer. It is the Push-Pull method that enables the pressure in the crossover passage 22 of the split-cycle engine 10 to be maintained at typically 20 bar or higher during all four strokes of the engine's cycle when the engine is operating at full load.

As discussed earlier, the exhaust valve 34 is disposed in the exhaust port 35 of the cylinder head 33 separate from the crossover passage 22. The structural arrangement of the exhaust valve 34 not being disposed in the crossover passage 22, and therefore the exhaust port 35 not sharing any common portion with the crossover passage 22, is preferred in order to maintain the trapped mass of gas in the crossover passage 22 during the exhaust stroke. Accordingly, large cyclic drops in pressure, which may force the pressure in the crossover passage below the predetermined minimum pressure, are prevented.

The XovrE valve 26 opens shortly before the expansion piston 30 reaches its top dead center position. At this time, the pressure ratio of the pressure in the crossover passage 22 to the pressure in the expansion cylinder 14 is high, due to the fact that the minimum pressure in the crossover passage is typically 20 bar absolute or higher and the pressure in the expansion cylinder during the exhaust stroke is typically about one to two bar absolute. In other words, when the XovrE valve 26 opens, the pressure in the crossover passage 22 is substantially higher than the pressure in the expansion cylinder 14 (typically in the order of 20 to 1 or greater). This high pressure ratio causes initial flow of the air and/or fuel charge to flow into the expansion cylinder 14 at high speeds. These high flow speeds can reach the speed of sound, which is referred to as sonic flow. This sonic flow is particularly advantageous to the split-cycle engine 10 because it causes a rapid combustion event, which enables the split-cycle engine 10 to maintain high combustion pressures even though ignition is initiated while the expansion piston 30 is descending from its top dead center position.

The split-cycle air-hybrid engine 10 also includes an air reservoir (tank) 40, which is operatively connected to the crossover passage 22 by an air reservoir tank valve 42. Embodiments with two or more crossover passages 22 may include a tank valve 42 for each crossover passage 22, which connect to a common air reservoir 40, or alternatively each crossover passage 22 may operatively connect to separate air reservoirs 40.

The tank valve 42 is typically disposed in an air tank port 44, which extends from the crossover passage 22 to the air tank 40. The air tank port 44 is divided into a first air tank port section 46 and a second air tank port section 48. The first air tank port section 46 connects the air tank valve 42 to the crossover passage 22, and the second air tank port section 48 connects the air tank valve 42 to the air tank 40.

The volume of the first air tank port section 46 includes the volume of all additional recesses which connect the tank valve 42 to the crossover passage 22 when the tank valve 42 is closed. Preferably, the volume of the first air tank port section 46 is small (e.g., less than approximately 20%) relative to the volume of the crossover passage 22. More preferably, the first air tank port section 46 is substantially non-existent, that is, the tank valve 42 is most preferably disposed such that it is flush against the outer wall of crossover passage 22.

The tank valve 42 may be any suitable valve device or system. For example, the tank valve 42 may be a pressure-activated check valve, or an active valve which is activated by various valve actuation devices (e.g., pneumatic, hydraulic, cam, electric or the like). Additionally, the tank valve 42 may comprise a tank valve system with two or more valves actuated with two or more actuation devices.

The air tank 40 is utilized to store energy in the form of compressed air and to later use that compressed air to power the crankshaft 16, as described in aforementioned U.S. Pat. No. 7,353,786 to Scuderi et al. This mechanical means for storing potential energy provides numerous potential advantages over the current state of the art. For instance, the split-cycle engine 10 can potentially provide many advantages in fuel efficiency gains and NOx emissions reduction at relatively low manufacturing and waste disposal costs in relation to other technologies on the market such as diesel engines and electric-hybrid systems.

The air hybrid split-cycle engine 10 can be run in a normal operating mode (referred to as the engine firing (EF) mode or as the normal firing (NF) mode) and four basic air hybrid modes. In the EF mode, the engine 10 functions normally as previously described in detail herein, operating without the use of its air tank 40. In the EF mode, the tank valve 42 remains closed to isolate the air tank 40 from the basic split-cycle engine 10.

In the four hybrid modes, the engine 10 operates with the use of its air tank 40. The four hybrid modes are:

1.Air Expander (AE) mode, which includes using compressed air energy from the air tank 40 without combustion;

2.Air Compressor (AC) mode, which includes storing compressed air energy into the air tank 40 without combustion;

3.Air Expander and Firing (AEF) mode, which includes using compressed air energy from the air tank 40 with combustion; and 4.Firing and Charging (FC) mode, which includes storing compressed air energy into the air tank 40 with combustion.

In the split-cycle engine 10, the compression and expansion cylinders 12, 14 are positioned in-line with each other and share a common cylinder head 33 in which the crossover passage 22 is formed. Additionally, the common head 33 must include several cooling passages (not shown) to enable engine coolant to be pumped through the head 33 to remove heat from the compression cylinder 12, the expansion cylinder 14, and the crossover passage 22. Because the crossover passage 22 is formed integrally with the cylinder head 33, it is very difficult to independently control the temperature of the crossover passage 22 (and the fluid therein) relative to the cylinders 12, 14.

Also, the relative lack of available space in the cylinder head 33 imposes undesirable size and shape restrictions on the crossover passage(s) 22 and the air reservoir control valve (s) 42. For example, the crossover passage 22 or the first air tank port section 46, which connects the valve 42 to the crossover passage 22, may have to be curved in order to avoid breaking through or getting too close to the various cooling passages. The curved crossover passages would then be longer than necessary, which would increase heat losses therein and decrease efficiency. The curved first tank port section 46 would undesirably combine with the volume of the crossover passage to decrease pressure in the crossover passage and also decrease efficiency. Moreover, the common head may become so crowded that it may become very difficult (if not virtually impossible) to connect a tank valve 42 to the crossover passage 22 without breaking through or coming too close to some of the cooling passages.

Still further, the casting process that is typically used to form the crossover passage 22 in the cylinder head 33 leaves behind manufacturing artifacts that disrupt air flow in the crossover passage 22 and undesirably limit the shape and size of the crossover passage(s) 22. Accordingly, there is a need for improved split-cycle engine configurations.

SUMMARY

A split-cycle air hybrid engine with improved efficiency is disclosed in which the centerline of a compression cylinder is positioned at a non-zero angle with respect to the centerline of an expansion cylinder such that the cylinders of the engine have a V-shaped configuration. The centerlines of the respective cylinders do not actually form a "V", as they do not typically intersect with each other. Rather, the centerlines are usually spaced apart from one another in the axial direction of the crankshaft (i.e., to accommodate the thickness of the respective crank throws for each cylinder). When viewed along the axis of rotation of the crankshaft, however, the centerlines have the appearance of a "V." In one embodiment, the centerlines of the respective cylinders intersect with the axis of rotation of the crankshaft such that the apex of the V is formed at the axis of rotation of the crankshaft.

In another embodiment, one or both of the compression cylinder and the expansion cylinder have a centerline that is "offset," meaning the centerline does not intersect with the axis of rotation of the crankshaft. In this embodiment, it is preferable that the centerlines of the cylinders intersect with a line (i.e., the line on which the apex of the V is formed) that is located below the axis of rotation of the crankshaft (i.e., located on the side opposite the cylinders relative to the axis of rotation of the crankshaft). The line on which the apex of the V is formed can optionally be parallel to the axis of rotation of the crankshaft. Modular crossover passages, crossover passage manifolds, thermal regulation systems, and associated air reservoir valve assemblies are also disclosed.

In one aspect of at least one embodiment of the invention, a V-shaped split-cycle air hybrid engine is provided that includes a compression cylinder having a centerline that is positioned at a non-zero angle with respect to the centerline of an expansion cylinder. In one embodiment, the non-zero angle is in a range of about 10 degrees to about 120 degrees. The non-zero angle can also be selected from the group consisting of about 30 degrees, about 45 degrees, and about 60 degrees.

In another aspect of at least one embodiment of the invention, a split-cycle engine is provided that includes a first cylinder head coupled to a compression cylinder, a second cylinder head coupled to an expansion cylinder, and at least one crossover passage formed externally to the first and second cylinder heads and configured to selectively transfer fluid between the first and second cylinder heads.

In one embodiment, the engine is an air hybrid engine and the at least one crossover passage includes an air reservoir valve for selectively placing an air reservoir in fluid communication with the first or second cylinder heads. The at least one crossover passage can include first and second crossover passages, each having an associated crossover compression valve and a crossover expansion valve. The crossover compression valves and the crossover expansion valves can be outwardly opening. In one embodiment, the air reservoir valve is outwardly opening.

In another aspect of at least one embodiment of the invention, a split-cycle air hybrid engine is provided that includes a crankshaft that rotates about a crankshaft axis and a compression cylinder having a centerline offset from the crankshaft axis that intersects an offset axis, the offset axis being parallel to the crankshaft axis and offset therefrom. The engine also includes an expansion cylinder having a centerline that intersects the offset axis, and the centerline of the compression cylinder is positioned at a non-zero angle with respect to the centerline of the expansion cylinder when viewed along the offset axis.

In another aspect of at least one embodiment of the invention, a split-cycle air hybrid engine is provided that includes a crankshaft that rotates about a crankshaft axis, a first cylinder that is offset such that a centerline of the first cylinder does not intersect the crankshaft axis, and a second cylinder having a centerline, wherein the centerline of the first cylinder is positioned at a non-zero angle with respect to the centerline of the second cylinder. The first cylinder can be a compression cylinder or the first cylinder can be an expansion cylinder. In one embodiment, the second cylinder is offset such that a centerline of the second cylinder does not intersect the crankshaft axis.

In another aspect of at least one embodiment of the invention, a split-cycle engine is provided that includes a first cylinder head coupled to a compression cylinder, a second cylinder head coupled to an expansion cylinder, and a thermally regulated crossover manifold configured to selectively transfer fluid between the first and second cylinder heads. The manifold includes at least one insulated crossover passage and at least one cooled crossover passage. In one embodiment, the manifold includes a plurality of valves configured to selectively divert fluid through either the at least one cooled crossover passage or the at least one insulated crossover passage depending on an operating condition of the engine. The engine can also include one or more fluid jackets through which engine coolant flows, the one or more fluid jackets being disposed in proximity to the at least one cooled crossover passage An insulative material can also be provided and that is disposed around the at least one insulated crossover passage. In one embodiment, the insulative material is a ceramic. The insulated crossover passage can also be heated.

BRIEF DESCRIPTION OF THE DRAWINGS

The invention will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Figure 2:
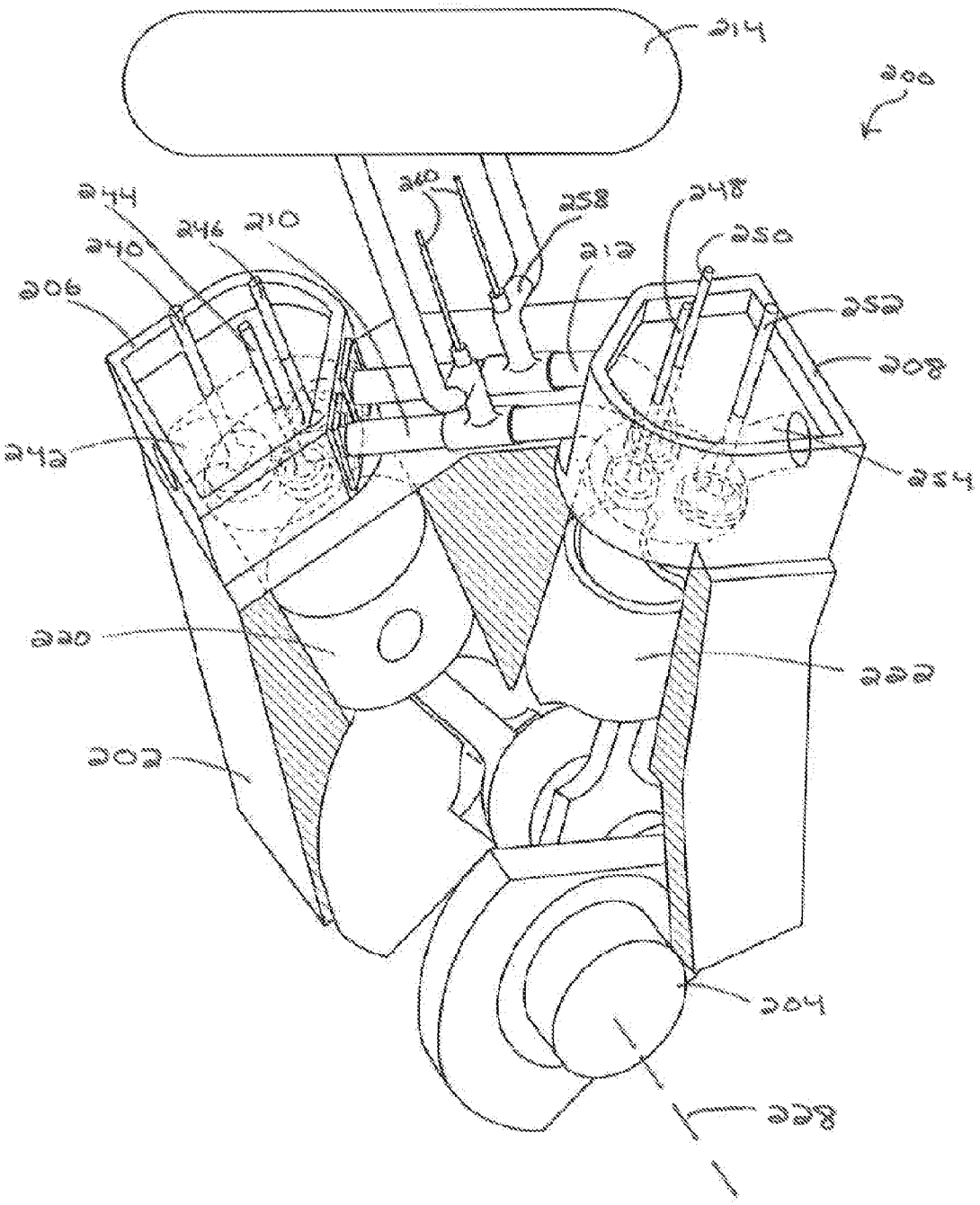
FIG. 2 is a perspective cross-sectional view of one embodiment of a split-cycle air hybrid engine according to the present invention.
Figure 3:
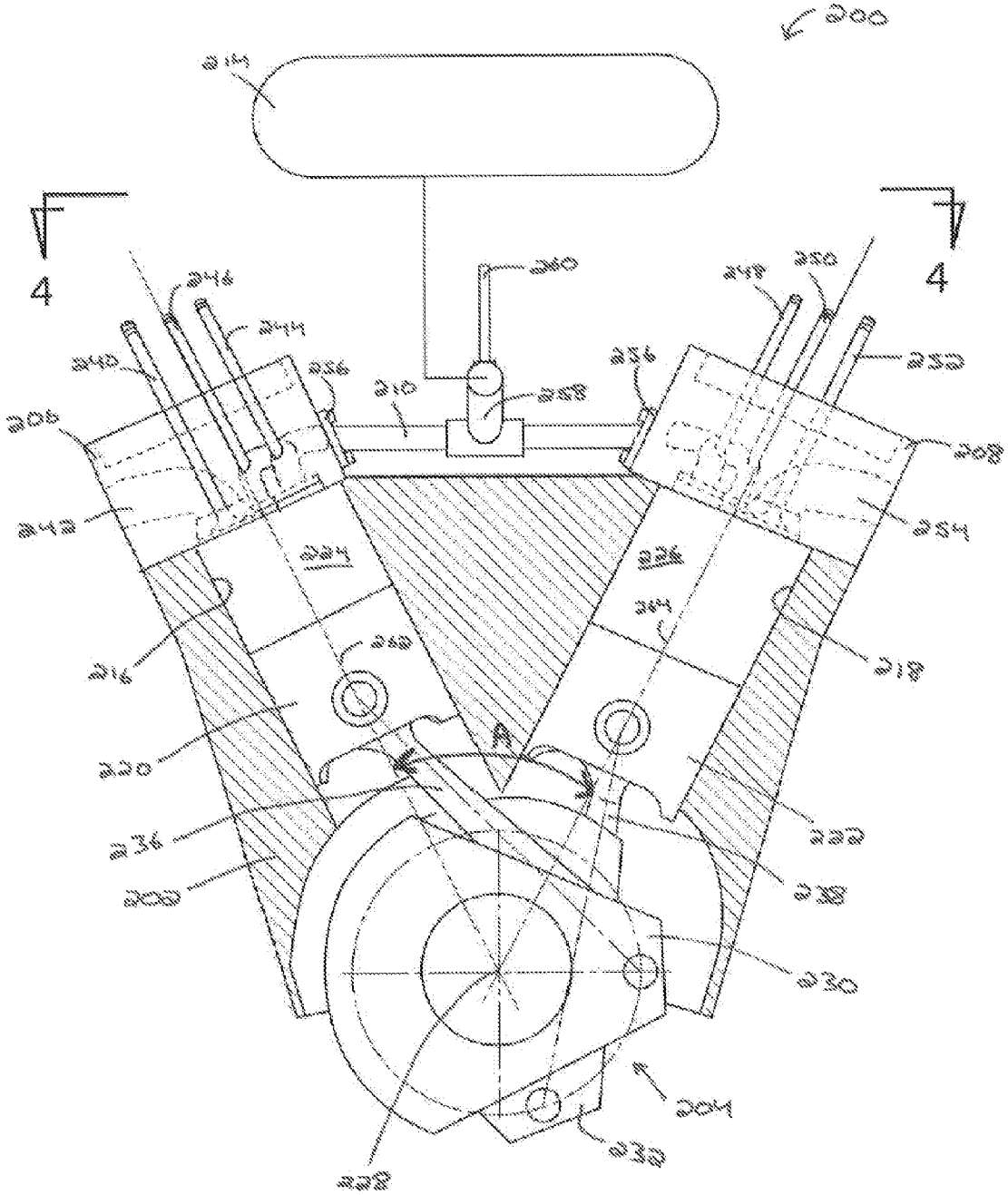
FIG. 3 is a cross-sectional profile view of the split-cycle air hybrid engine of FIG. 2.
Figure 4:
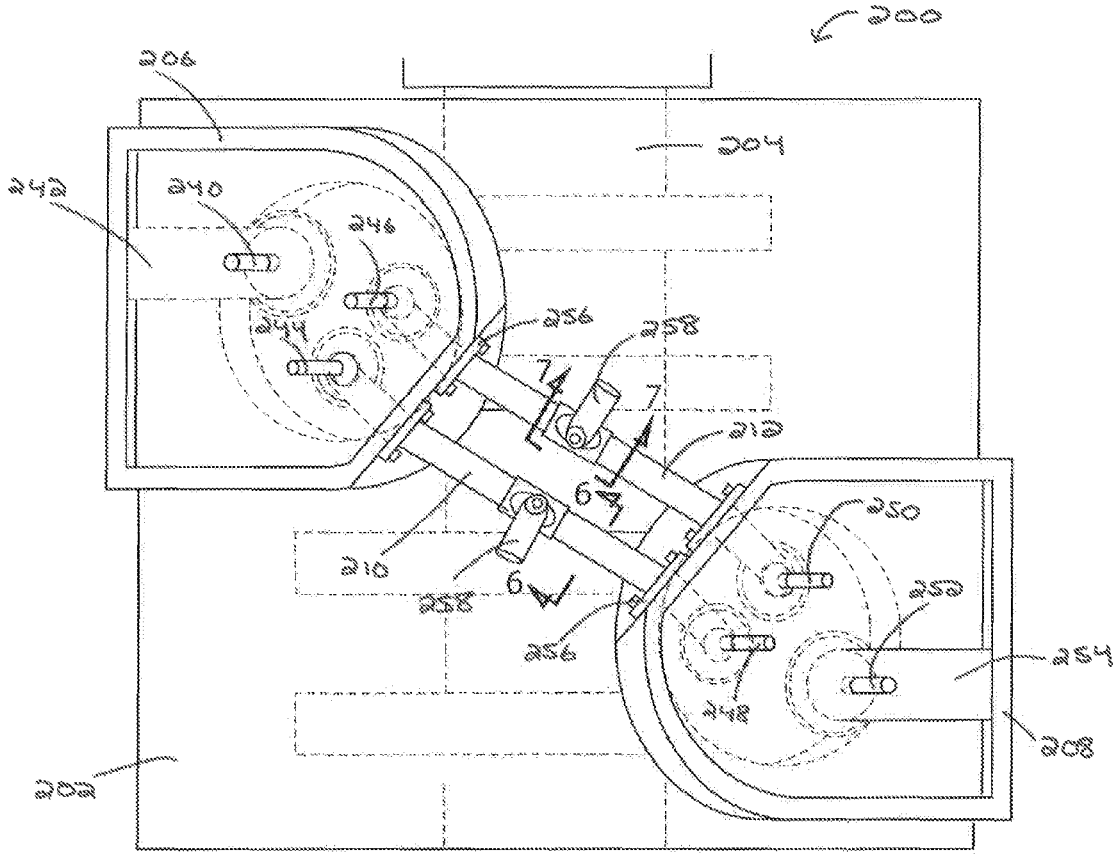
FIG. 4 is a cross-sectional plan view of the split-cycle air hybrid engine of FIGS. 2 and 3 taken along the line 4-4 in FIG. 3.

FIGS. 2-4 illustrate one exemplary embodiment of a split-cycle air hybrid engine 200 according to the present invention. The engine 200 generally includes an engine block 202, a crankshaft 204 rotating about a crankshaft axis (or axis of rotation) 228, first and second cylinder heads 206, 208, first and second crossover passages 210, 212, and an air reservoir 214.

As shown in FIG. 3, the engine block 202 defines at least one compression cylinder 216 and at least one expansion cylinder 218. As shown, the centerlines of the compression and expansion cylinders 216, 218 are positioned at a non-zero angle A relative to each other such that the engine 200 is oriented in a V-shaped configuration when viewed along the crankshaft axis 228. The angle A can be between about 0.1 degrees and about 180 degrees, between about 5 degrees and about 150 degrees, between about 10 degrees and about 120 degrees, between about 15 degrees and about 90 degrees, between about 30 degrees and about 60 degrees, between about 10 degrees and about 30 degrees, between about 60 degrees and about 90 degrees, and/or between about 45 degrees and about 55 degrees. For example, the angle A can be 0.1 degrees, 15 degrees, 30 degrees, 45 degrees, 60 degrees, 75 degrees, 90 degrees, 105 degrees, 120 degrees, 150 degrees, 165 degrees, or 180 degrees. In the illustrated embodiment, the compression and expansion cylinders 216, 218 are oriented at an angle A of about 54 degrees with respect to each other.

It will be appreciated that the engine 200 can include virtually any number of compression and/or expansion cylinders, and that the number of compression cylinders need not necessarily be equal to the number of expansion cylinders. In this embodiment, the engine 200 includes one compression cylinder and one expansion cylinder. The four strokes of the Otto cycle are "split" over the compression and expansion cylinders such that the compression cylinder 216 contains the intake and compression strokes and the expansion cylinder 218 contains the expansion and exhaust strokes. The Otto cycle is therefore completed in the compression and expansion cylinders 216, 218 once per crankshaft revolution (360 degrees CA).

Upper ends of the cylinders 216, 218 are closed by the respective cylinder heads 206, 208. The compression and expansion cylinders 216, 218 receive for reciprocation a compression piston 220 and an expansion (or "power") piston 222, respectively. The first cylinder head 206, the compression piston 220 and the compression cylinder 216 define a variable volume compression chamber 224 in the compression cylinder 216. The second cylinder head 208, the expansion piston 222 and the expansion cylinder 218 define a variable volume combustion chamber 226 in the expansion cylinder 218.

Having separated cylinder heads 206, 208 oriented in the V-shaped configuration allows for better access to the crossover passages 210, 212, which makes it easier to attach the air reservoir valve 260 thereto, thereby facilitating the construction of the air reservoir 214.

This configuration also avoids the necessity of forming the crossover passages in the common cylinder head 33, which, as discussed in detail below, enables independent thermal control of the crossover passages relative to the compression and expansion cylinders. The V-shaped configuration of engine 200 enables a substantial portion of the crossover passages 210, 212 to be located outside of the first and second cylinder heads 206, 208, as, for example, in a separate crossover passage manifold (not shown). Accordingly, separate cooling passages can be designed for just the crossover passages, making the area around the crossover passages more open and accessible. This means that the crossover passages can be made straighter and shorter, which would cut down on heat loss and increase engine efficiency. Additionally, one or more air reservoir valves 260 can be more easily fitted to the crossover passages 210, 212 and connected to the air reservoir 214 with little structural problems in hitting or coming too close to the cooling passages. Moreover, the connection to the air reservoir 214 can be made straight and the air reservoir valve(s) 260 can be mounted flush against the outer surface of the crossover passages 210, 212 to further increase crossover passage pressure and engine efficiency.

The crankshaft 204 is journaled into the engine block 202 for rotation about the crankshaft axis 228 and includes axially displaced and angularly offset first and second crank throws 230, 232, having a phase angle therebetween. The first crank throw 230 is pivotally joined by a first connecting rod 236 to the compression piston 220 and the second crank throw 232 is pivotally joined by a second connecting rod 238 to the expansion piston 222 to reciprocate the pistons 220, 222, respectively, in their respective cylinders 216, 218 in a timed relation determined by the angular offset of the crank throws 230, 232 and the geometric relationships of the cylinders 216, 218, the crankshaft 204, and the pistons 220, 222. Alternative mechanisms for relating the motion and timing of the pistons 220, 222 can be utilized if desired.

The cylinder heads 206, 208 include various passages, ports and valves suitable for accomplishing the desired purposes of the split-cycle air hybrid engine 200. In the illustrated embodiment, a first, compression-side cylinder head 206 is provided that includes an inwardly-opening intake valve 240 for controlling fluid flow between an intake port 242 and the compression cylinder 216. The cylinder head 206 also includes first and second outwardly-opening poppet crossover compression (XovrC) valves 244, 246 at the inlets of the respective crossover passages 210, 212, respectively, for controlling fluid flow between the compression cylinder 216 and the crossover passages 210, 212.

During the intake stroke, intake air is drawn through the intake port 242 and into the compression cylinder 216 via the intake valve 240. During the compression stroke, the compression piston 220 pressurizes the air charge and drives the air charge into the crossover passages 210, 212 which act as intake passages for the expansion cylinder 218.

The illustrated engine 200 also includes a second, expansion-side cylinder head 208. The head 208 includes first and second outwardly-opening poppet crossover expansion (XovrE) valves 248, 250 at the outlets of the respective crossover passages 210, 212 which control fluid flow between the crossover passages 210, 212 and the expansion cylinder 218. The head 208 also includes an inwardly-opening poppet exhaust valve 252 for controlling fluid flow between the expansion cylinder 218 and an exhaust port 254.

One or more fuel injectors (not shown) inject fuel into the pressurized air at the exit ends of the crossover passages 210, 212 in correspondence with the opening of the XovrE valves 248, 250 respectively. Alternatively, or in addition, fuel can be injected directly into the expansion cylinder 218 and/or directly into one or both of the crossover passages 210, 212. The fuel-air charge fully enters the expansion cylinder 218 shortly after the expansion piston 222 reaches its TDC position. As the piston 222 begins its descent from its TDC position, and while one or more of the XovrE valves 248, 250 are still open, one or more spark plugs (not shown) are fired to initiate combustion (typically between 10 to 20 degrees CA after TDC of the expansion piston 222). The spark plug(s) are mounted in the cylinder head 208 with electrodes extending into the combustion chamber 226 for igniting air fuel charges at precise times by an ignition control (not shown). It should be understood that the engine 200 can also be a diesel engine and can be operated without a spark plug. Moreover, the engine 200 can be designed to operate on any fuel suitable for reciprocating piston engines in general, such as hydrogen or natural gas.

After the spark plug is fired, the XovrE valves 248, 250 are closed before the resulting combustion event enters the crossover passages 210, 212. The combustion event drives the expansion piston 222 downward in a power stroke. Exhaust gases are pumped out of the expansion cylinder 222 and through the exhaust port 254 via the exhaust valve 252 during the exhaust stroke.

The crossover passages 210, 212 can have a variety of configurations. While the illustrated engine 200 includes two crossover passages 210, 212, it can also have only a single crossover passage or can have more than two crossover passages.

The illustrated crossover passages 210, 212 generally include an elongated hollow flow tube with mounting flanges 256 formed on either end for mounting the crossover passages 210, 212 to the cylinder heads 206, 208. The crossover passages 210, 212 also include at least one air reservoir valve assembly 258 that houses at least one air reservoir valve 260 (see FIG. 3), as discussed in further detail below. In the illustrated embodiment, the crossover passages 210, 212 have a generally circular cross-section, although virtually any cross-sectional shape can be used without departing from the scope of the present invention. For example, the crossover passages can have an ellipsoidal cross-section. The crossover passages 210, 212 can be generally straight as shown or can include one or more curves or bends. In one embodiment, the crossover passages are sized and shaped such that they have different internal volumes to accommodate flow for different engine load ranges. For example, the crossover passage 210 could be sized to have approximately half the volume of the crossover passage 212. Accordingly, the smaller volume passage 210 could be used primarily for the lower third of the engine load range, the larger volume passage 212 could be used primarily for the middle third of the engine load range, and the combined passages 210, 212 could be used primarily for the upper third of the engine load range.

The air reservoir valve assemblies 258 of the crossover passages 210, 212 control fluid flow between the crossover passages 210, 212 and the air reservoir 214. The air reservoir 214 is sized to receive and store compressed air energy from a plurality of compression strokes of the compression piston 220, and facilitates operation of the engine 200 in any of a variety of air hybrid modes, as explained below. It will be appreciated that each crossover passage 210, 212 can be coupled to its own respective air reservoir and/or can be coupled to a single shared air reservoir 214 as shown.

The valves in the engine 200 (i.e., the intake valve 240, the XovrC valves 244, 246, the XovrE valves 248, 250, the exhaust valve 252, the air reservoir valves 260, etc.) are typically actuated by camshafts (not shown) having cam lobes for respectively actuating and engaging the valves either directly or via one or more intermediate elements. Each valve can have its own cam and/or its own camshaft, or two or more valves can be actuated by common cams and/or camshafts. Alternatively, one or more of the valves can be mechanically, electronically, pneumatically, and/or hydraulically actuated variably.

The engine 200 is capable of operating in any of the aforementioned air hybrid modes (i.e., AE, AC, AEF, and FC modes).

Figure 1:
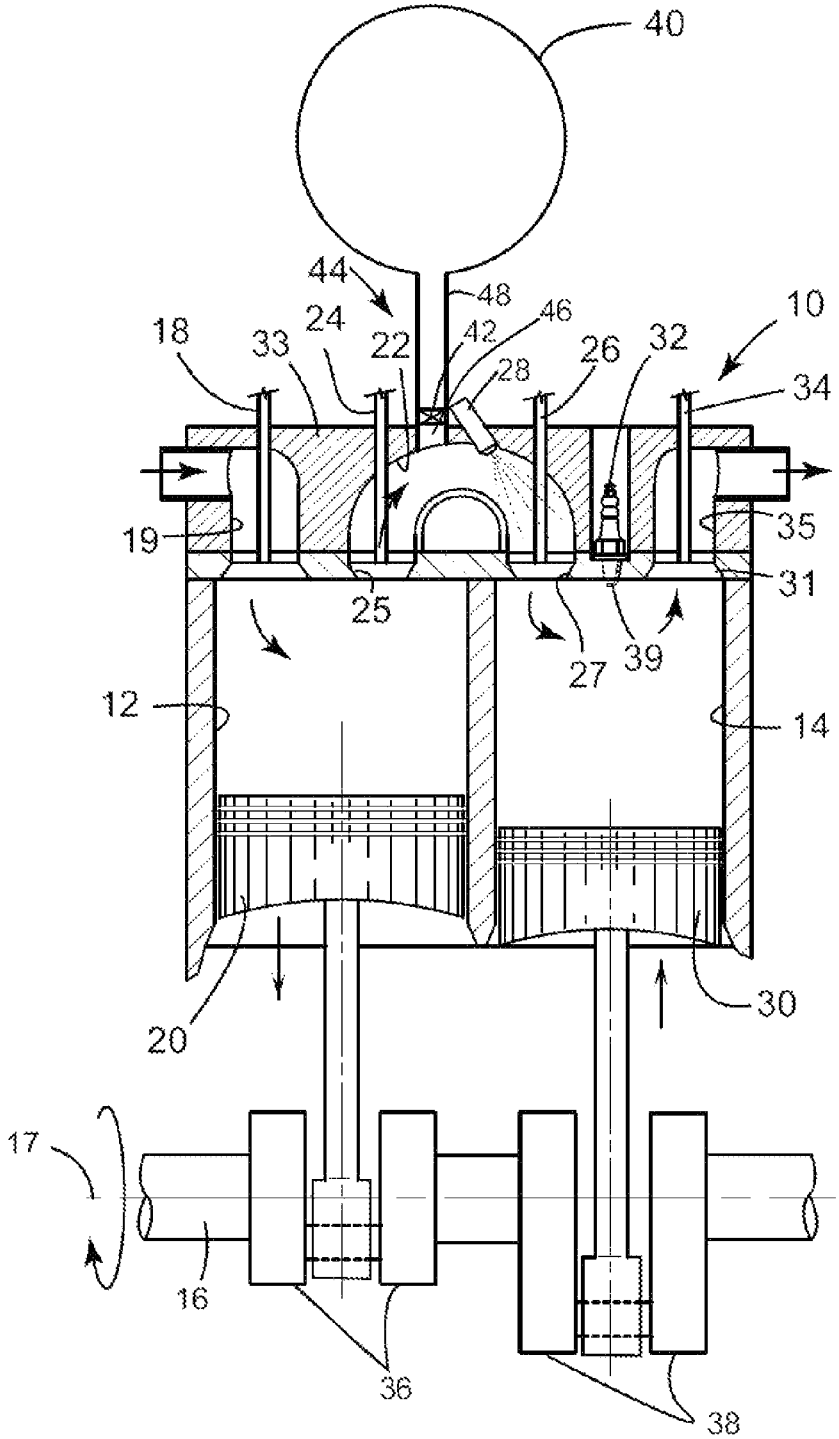
FIG. 1 Prior Art
FIG. 1 is a schematic cross-sectional view of a prior art split-cycle air hybrid engine.
Figure 5:
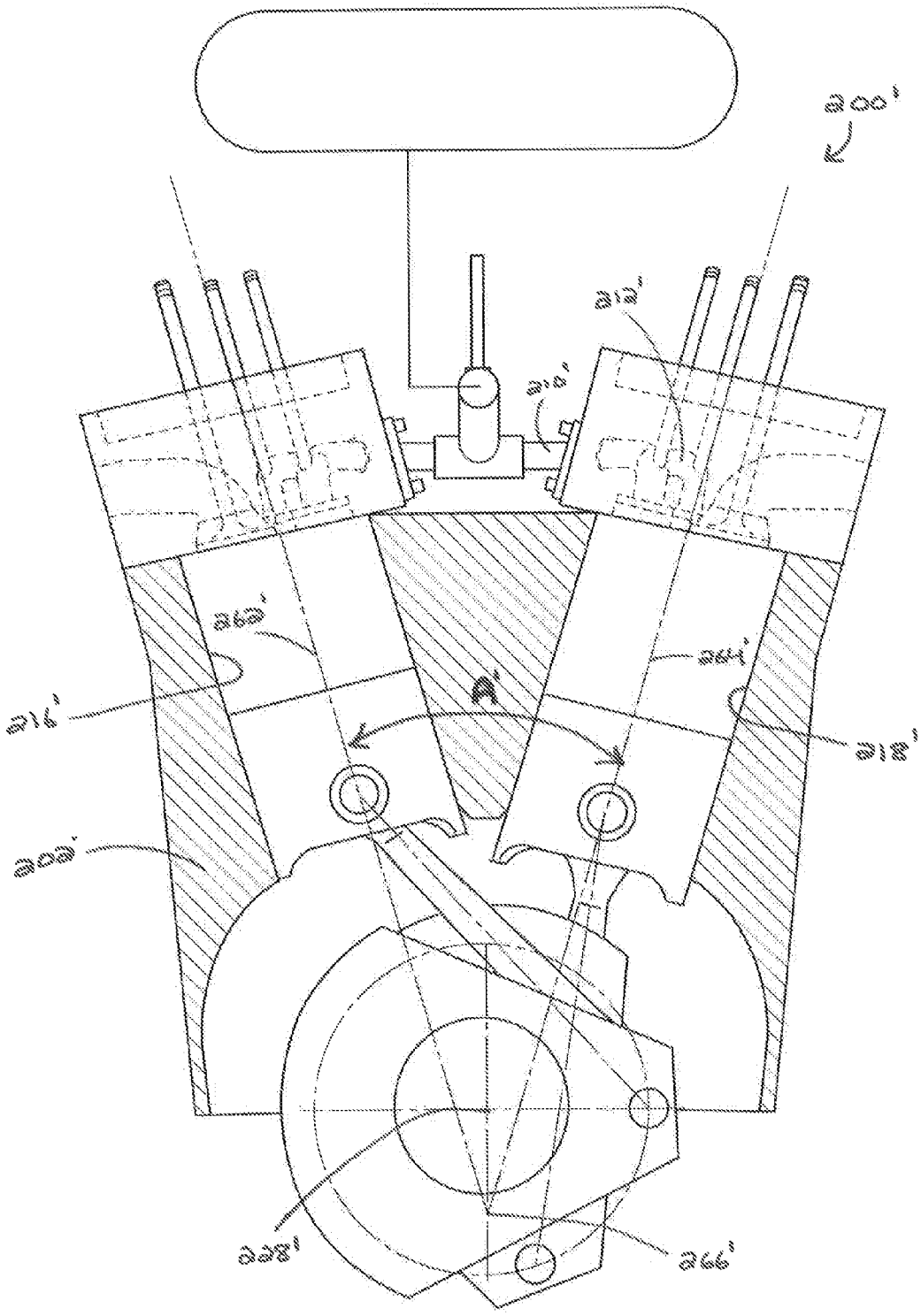
FIG. 5 is a cross-sectional profile view of another embodiment of a split-cycle air hybrid engine having offset cylinder centerlines according to the present invention.

In existing split-cycle engines, the respective centerlines of the expansion and compression cylinders are generally parallel to one another and intersect the axis of rotation of the crankshaft, as shown in FIG. 1. In the engine 200 of FIG. 3, the centerline 262 of the compression cylinder 216 and the centerline 264 of the expansion cylinder 218, while not parallel to one another, do intersect with the rotational axis 228 of the crankshaft 204. This need not always be the case, however. In other words, one or both of the compression cylinder and the expansion cylinder can be "offset," meaning that their centerlines do not intersect the axis of rotation of the crankshaft. In such embodiments, it is preferable that the centerlines of the cylinders intersect with a line (i.e., the line on which the apex of the V is formed) that is located below the axis of rotation of the crankshaft (i.e., located on the side opposite the cylinders relative to the axis of rotation of the crankshaft). The line on which the apex of the V is formed can optionally be parallel to the axis of rotation of the crankshaft. For example, FIG. 5 illustrates a split-cycle air hybrid engine 200' in which the centerlines 262', 264' of the compression and expansion cylinders 216', 218' do not intersect with the crankshaft axis 228'. Rather, the centerlines 262', 264' intersect with an offset axis 266' that is parallel to the crankshaft axis 228' but offset therefrom. This advantageously reduces friction between the piston skirt and the cylinder wall. In addition, this allows for the angle A' of the V-shaped engine block 202' to be reduced, which in turn allows for shorter crossover passages 210', 212'. With the shorter crossover passages 210', 212', there is less pressure drop and thermal loss across the passages which increases engine efficiency. A variety of offsets (i.e., distances between the crankshaft axis 228' and the offset axis 266') can be used without departing from the scope of the present invention.

Figure 6:
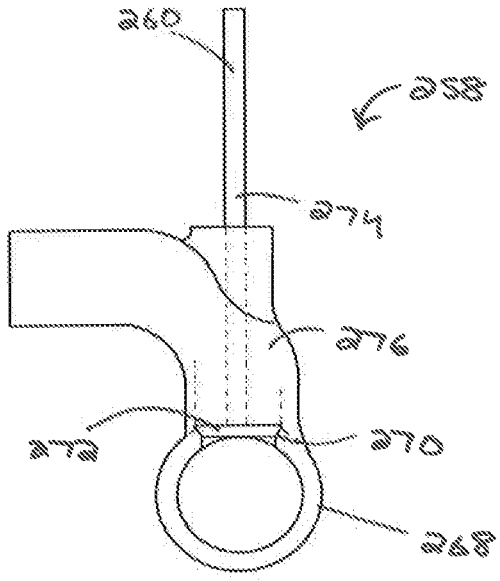
FIG. 6 is a partial cross-sectional profile view of the air reservoir valve assembly of FIG. 4 taken along the line 6-6 in FIG. 4.
Figure 7:
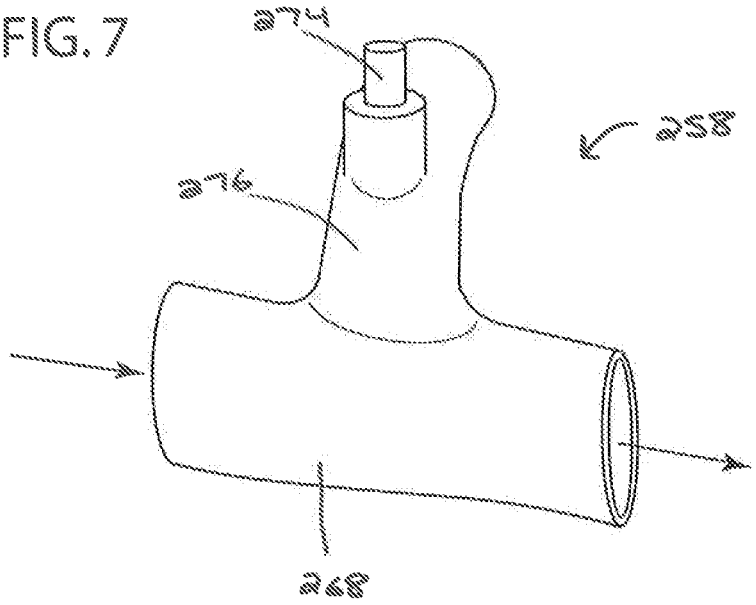
FIG. 7 is a perspective view of the air reservoir valve assembly of FIG. 4 taken along the line 7-7 in FIG. 4.

FIGS. 6-7 illustrate one embodiment of an air reservoir valve assembly 258 according to the present invention. As shown, the valve assembly 258 generally includes a longitudinal tubular portion 268 configured to be placed in-line with a crossover passage (i.e., the crossover passages 210, 212). In one embodiment, the valve assembly 258 is formed integrally with the crossover passage. Alternatively, the crossover passage can include first and second portions, each coupled to respective ends of the longitudinal tubular portion 268 of the valve assembly 258. The tubular portion 268 includes a valve seat 270 for forming a sealing engagement with the head 272 of an air reservoir valve 260. In the illustrated embodiment, the air reservoir valve 260 is an outwardly-opening (i.e., opening outwardly away from the interior of the tubular portion 268) poppet valve having a valve head 272 and a valve stem 274. The valve stem 274 extends through a transverse portion 276 of the valve assembly 258 that extends up and away from the tubular portion 268. Fluid communication between the interior of the transverse portion 276 and the interior of the tubular portion 268 is selectively established by actuating the air reservoir valve 260. The end of the transverse portion 276 opposite from the tubular portion 268 is coupled to an air reservoir (not shown), either directly or via one or more intermediate structures, such as tubes, valves, etc.

The valve stem 274 extends through a sidewall of the transverse portion 276 in a slidable arrangement such that linear motion can be imparted thereto by a cam or other valve actuator disposed outside of the transverse portion 276. A sealing feature is provided as known in the art to permit the valve stem 274 to slide with respect to the transverse portion 276 without permitting pressurized fluid in the transverse portion 276 to escape around the surface of the valve stem 274. It will be appreciated that a variety of other valve and/or housing types can be used to selectively place the air reservoir in fluid communication with one or more crossover passages.

Figure 8:
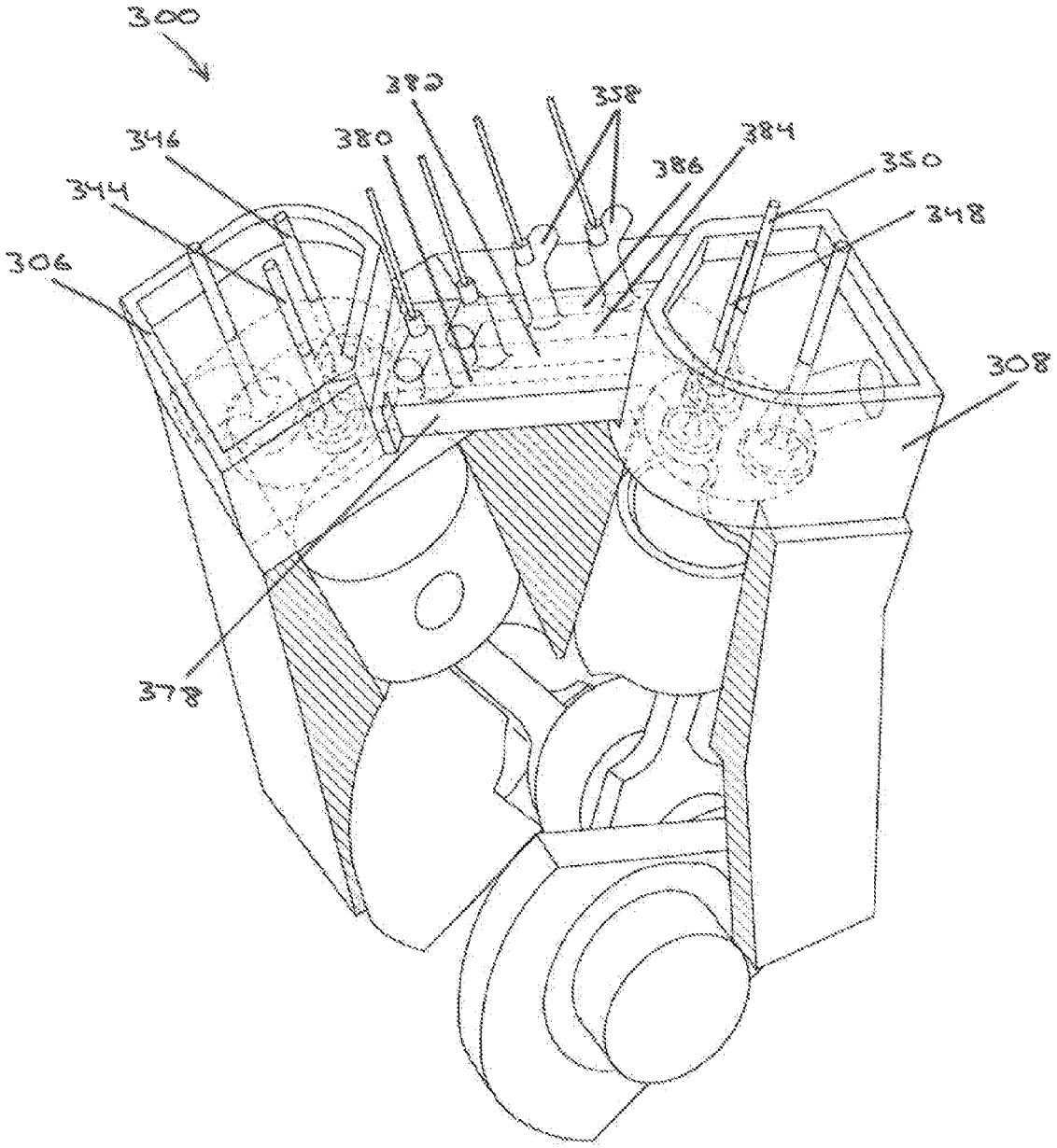
FIG. 8 is a perspective cross-sectional view of another embodiment of a split-cycle air hybrid engine having a thermally regulated crossover manifold according to the present invention.

As noted above, forming the crossover passages external to the cylinder head advantageously permits independent thermal regulation of the crossover passages. FIG. 8 illustrates one embodiment of a split-cycle air hybrid V-shaped engine 300 in which a thermal control system is employed to regulate the temperature of the crossover passages depending on various engine operating parameters. As shown, the engine 300 includes a thermally regulated crossover passage manifold 378 in which four crossover passages 380, 382, 384, 386 are formed. It will be appreciated that the use of such a crossover passage manifold is not limited to V-shaped split-cycle engines, and that the manifolds described herein can also be used with traditional inline split-cycle engines. Each passage in the manifold 378 has its own air reservoir valve assembly 358. Again, the number of illustrated crossover passages and air reservoir valves is merely exemplary, and any number of crossover passages and/or air reservoir valves can be used without departing from the scope of the present invention. The crossover passages 380, 382 share a common XovrC valve 344 and a common XovrE valve 348. Likewise, the crossover passages 384, 386 share a common XovrC valve 346 and a common XovrE valve 350. In other embodiments, each crossover passage includes its own unique XovrC and/or XovrE valve, or a single XovrC or XovrE valve is shared by more than two crossover passages.

Figure 9:
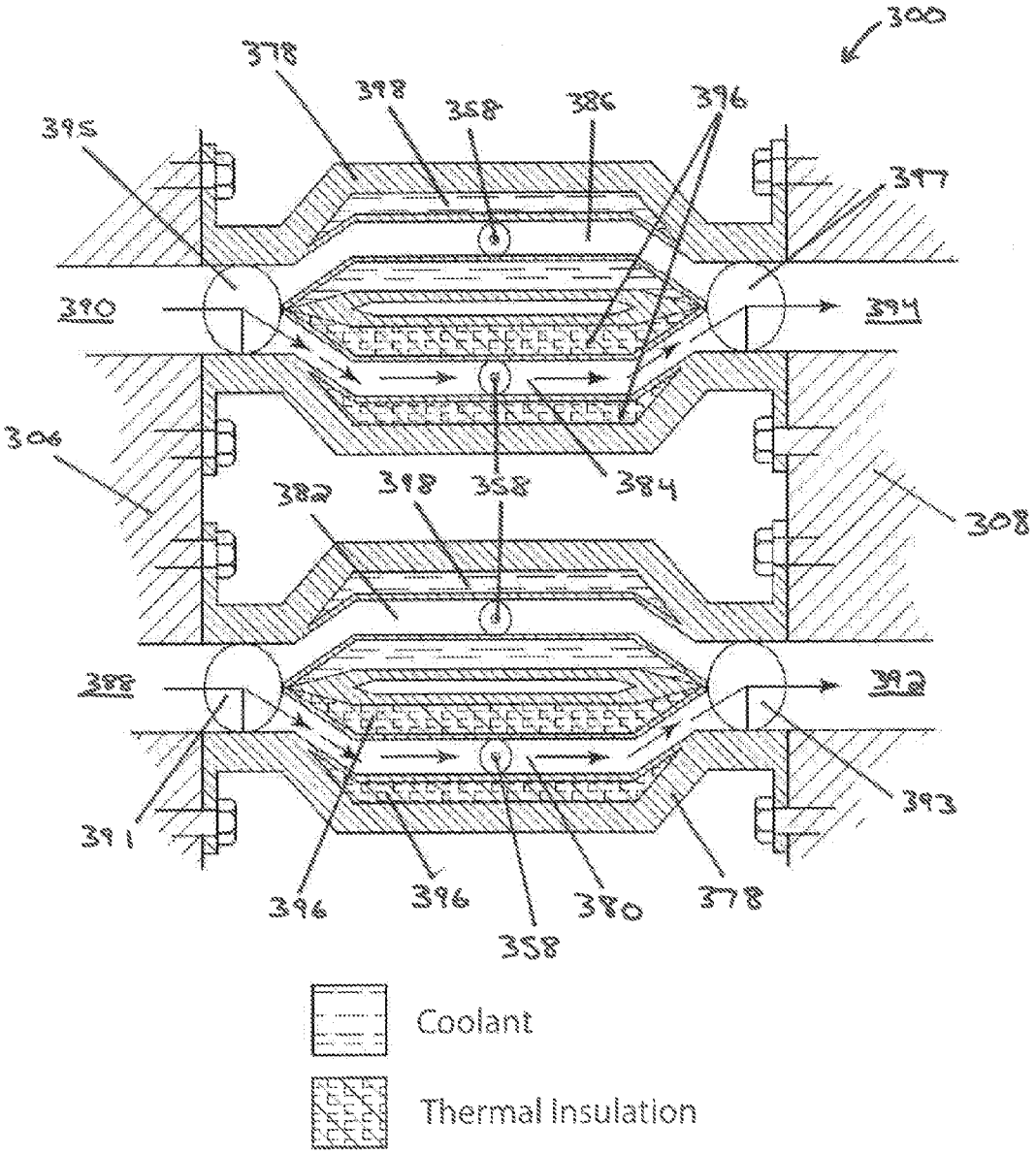
FIG. 9 is a schematic cross-sectional view of the thermally regulated crossover manifold of the engine of FIG. 8 having crossover passages and a set of control valves in a first configuration.

FIG. 9 illustrates a cross-sectional view of the crossover manifold 378. As shown, the ends of the manifold 378 are bolted to the first and second cylinder heads 306, 308. The manifold 378 includes first and second XovrC inlets 388, 390 through which fluid flow is controlled by the XovrC valves 344, 346, respectively. The manifold 378 also includes first and second XovrE outlets 392, 394 through which fluid flow is controlled by the XovrE valves 348, 350, respectively. Adjustable ball valves 391, 395 are disposed in the manifold inlets 388, 390 respectively, and adjustable ball valves 393, 397 are disposed in the manifold outlets 392, 394, respectively. The configurations of the ball valves 391, 393 are adjustable to selectively direct fluid entering the inlet 388 through either the crossover passage 380 or the crossover passage 382. Similarly, the configurations of the ball valves 395, 397 are adjustable to selectively direct fluid entering the inlet 390 through either the crossover passage 384 or the crossover passage 386. Any of a variety of means known in the art can be employed to change the configuration of the ball valves 391, 393, 395, 397, including mechanical, hydraulic, electromagnetic, and/or pneumatic actuators. In addition, the illustrated ball valves are only one exemplary type of valve that can be employed in the present invention, and a person having ordinary skill in the art will appreciate that any of a variety of known valve types can be used without departing from the scope of the present invention. The valves 391, 393, 395, 397 can optionally be two-position valves. In one embodiment, the switch between crossover passages can occur over a plurality of engine cycles (i.e., dozens, hundreds, etc.), which means that the valves 391, 393, 395, 397 need not necessarily be fast-actuating and can instead be of a slower, more durable or inexpensive variety.

The crossover passages 380, 384 include features for generally maintaining or increasing the temperature of fluid disposed therein or passing therethrough. In the embodiment of FIG. 9, the crossover passages 380, 384 are encased in a thermal insulation 396 configured to maintain engine heat within the crossover passages 380, 384. Any of a variety of insulative materials can be used for this purpose, including without limitation ceramics, Kevlar, plastics, composites, and the like. In addition, the crossover passages 380, 384 can be vacuum-lined (i.e., can be disposed within an outer tube in which a vacuum is generated). The engine 300 can also optionally include active heating elements. For example, high-temperature exhaust gasses can be routed through air passages formed alongside the crossover passages 380, 384, or can be used to heat oil or other fluid which can then be pumped through fluid jackets disposed adjacent to the crossover passages 380, 384. In one embodiment, the crossover passages 380, 384 can be wrapped in an electric heating coil.

The crossover passages 382, 386 include features for generally decreasing the temperature of fluid disposed therein or passing therethrough. As illustrated, fluid jackets 398 are formed in the manifold 378 in close proximity to the crossover passages 382, 386. Engine coolant or other fluid is routed through the fluid jackets 398 to cool the crossover passages 382, 386. The cooled crossover passages 382, 386 can also include other cooling mechanisms, such as heat sinks or fans and can optionally be formed from materials such as aluminum that are known to dissipate heat quickly.

The engine 300 also includes a thermal control computer (not shown) and any of a variety of associated sensors, thermostats, actuators, and/or other controls to facilitate precise temperature control.

In operation, the ball valves 391, 393, 395, 397 are selectively actuated such that fluid flowing from the compression cylinder to the expansion cylinder is either insulated, heated, or cooled as needed to improve the efficiency of the engine 300. For example, when the engine 300 is first started and has not yet reached operating temperature, the valves 391, 393, 395, 397 are placed in a first configuration, as shown in FIG. 9, such that the fluid compressed in the compression cylinder is routed through the insulated crossover passages 380, 384, and heated and/or insulated before entering the expansion cylinder. The flow of fluid in this configuration is indicated by the illustrated arrows. This configuration is also used when the engine 300 is operating under low loads (e.g., when the engine is operating below about 70% of full load). By heating and/or insulating the incoming air charge before it reaches the expansion cylinder, crossover passage pressures are maintained at a high level, thereby improving overall efficiency.

Figure 10:
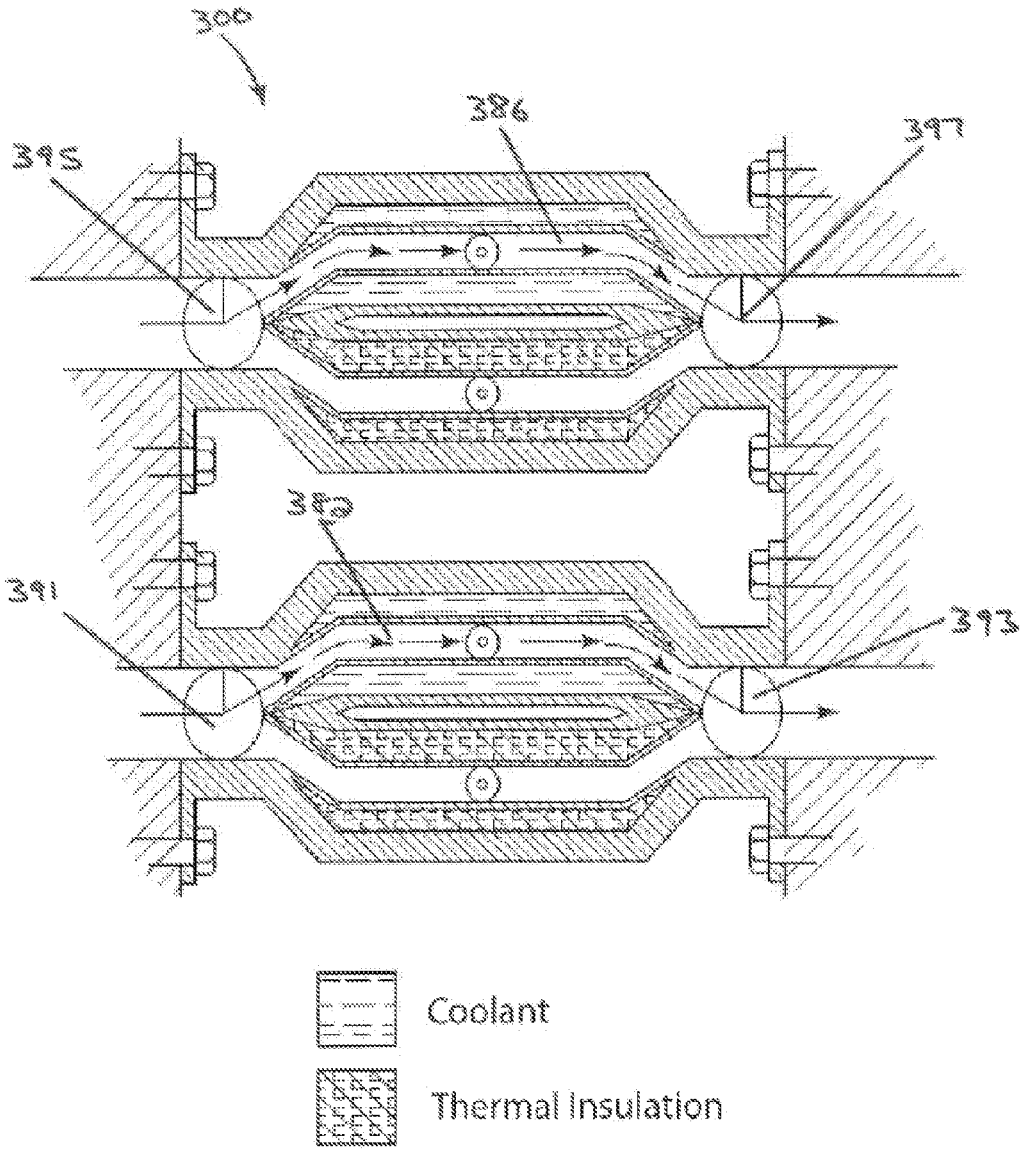
FIG. 10 is a schematic cross-sectional view of the crossover manifold of the engine of FIG. 8 with the set of control valves in a second configuration.

When the engine 300 is operating at high load (e.g., when the engine is operating above about 70% of its rated load), it is desirable to cool the air charge before it enters the expansion cylinder to prevent premature combustion and to improve output power. Accordingly, the valves 391, 393, 395, 397 are placed in a second configuration, as shown in FIG. 10, to route the fluid compressed in the compression cylinder through the cooled crossover passages 382, 386. The flow of fluid in this configuration is indicated by the illustrated arrows. By cooling the incoming air charge before it reaches the expansion cylinder, the temperature and pressure of the air charge is reduced which advantageously prevents pre-ignition and knocking. The cooled crossover passages 382, 386 can optionally have no air reservoir valve 358, since it may not be desirable to operate in an air hybrid mode under the conditions in which the cooled crossover passages 382, 386 are used.

Figure 11:
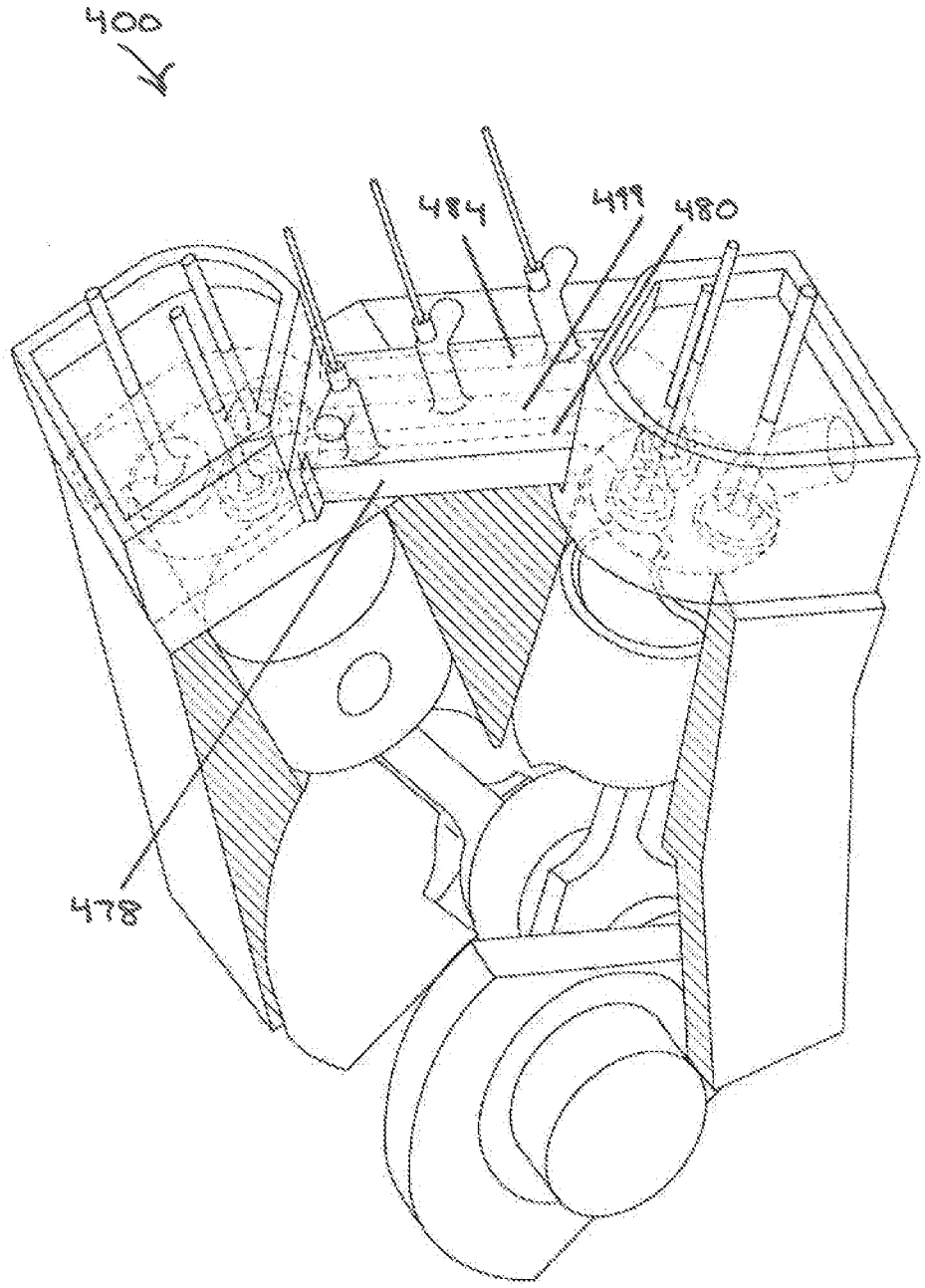
FIG. 11 is a perspective cross-sectional view of another embodiment of a split-cycle air hybrid engine having a thermally regulated crossover manifold according to the present invention.
Figure 12:
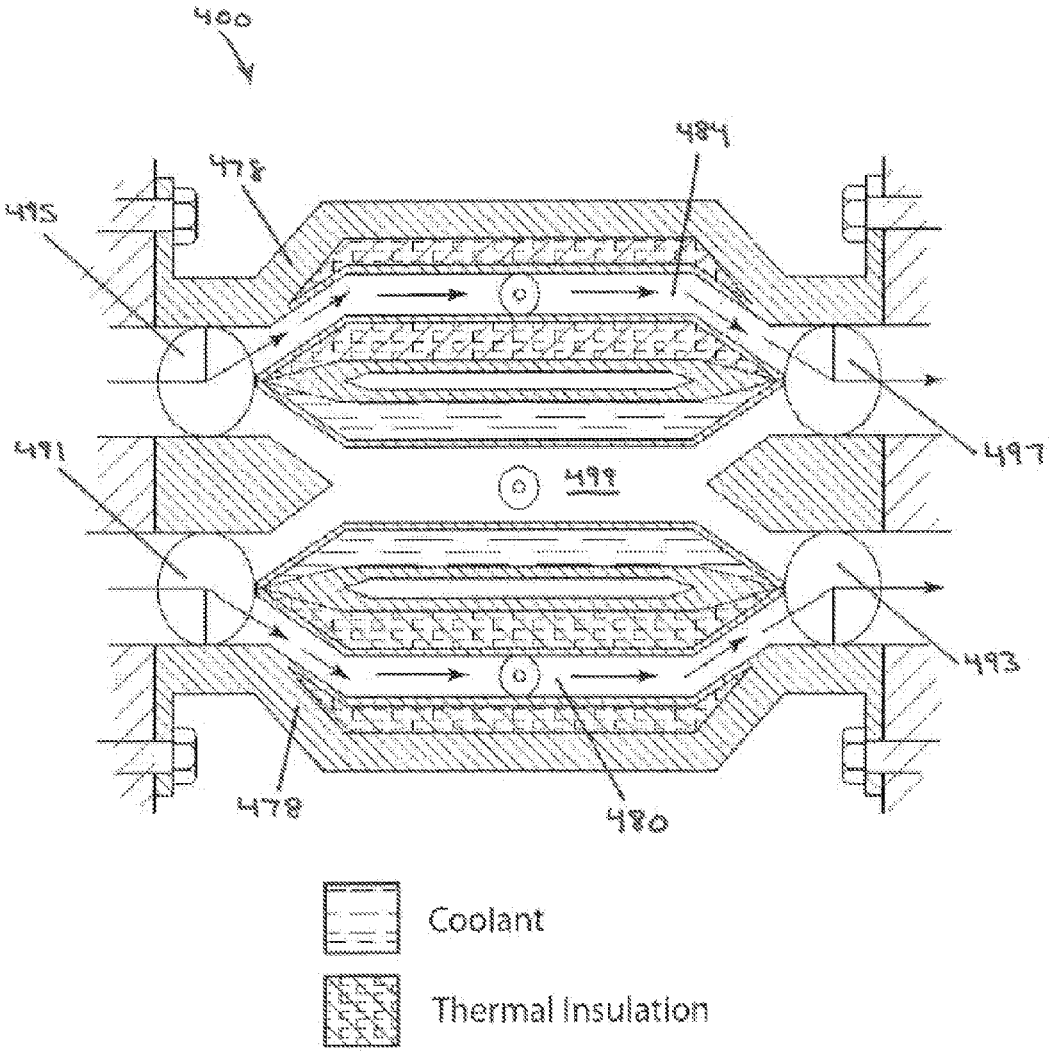
FIG. 12 is a schematic cross-sectional view of the thermally regulated crossover manifold of the engine of FIG. 11 having crossover passages and a set of control valves in a first configuration.

FIG. 11 illustrates another embodiment of a split-cycle air hybrid engine 400 in which a thermal control system is employed to regulate the temperature of the crossover passages depending on various engine operating parameters. The engine 400 is substantially identical to the engine 300 discussed above with respect to FIGS. 8-10, except that the manifold 478 of the engine 400 has only three crossover passages 480, 484, 499. In other words, whereas the engine 300 includes two cooled crossover passages 382, 386, the engine 400 instead has a single cooled crossover passage 499. Thus, as shown in FIG. 12, the engine 400 includes first and second insulated crossover passages 480, 484 and a central cooled crossover passage 499. It will be appreciated that the engine 400 could alternatively have first and second cooled crossover passages and that the insulated crossover passages could instead be merged into a single passage.

Figure 13:
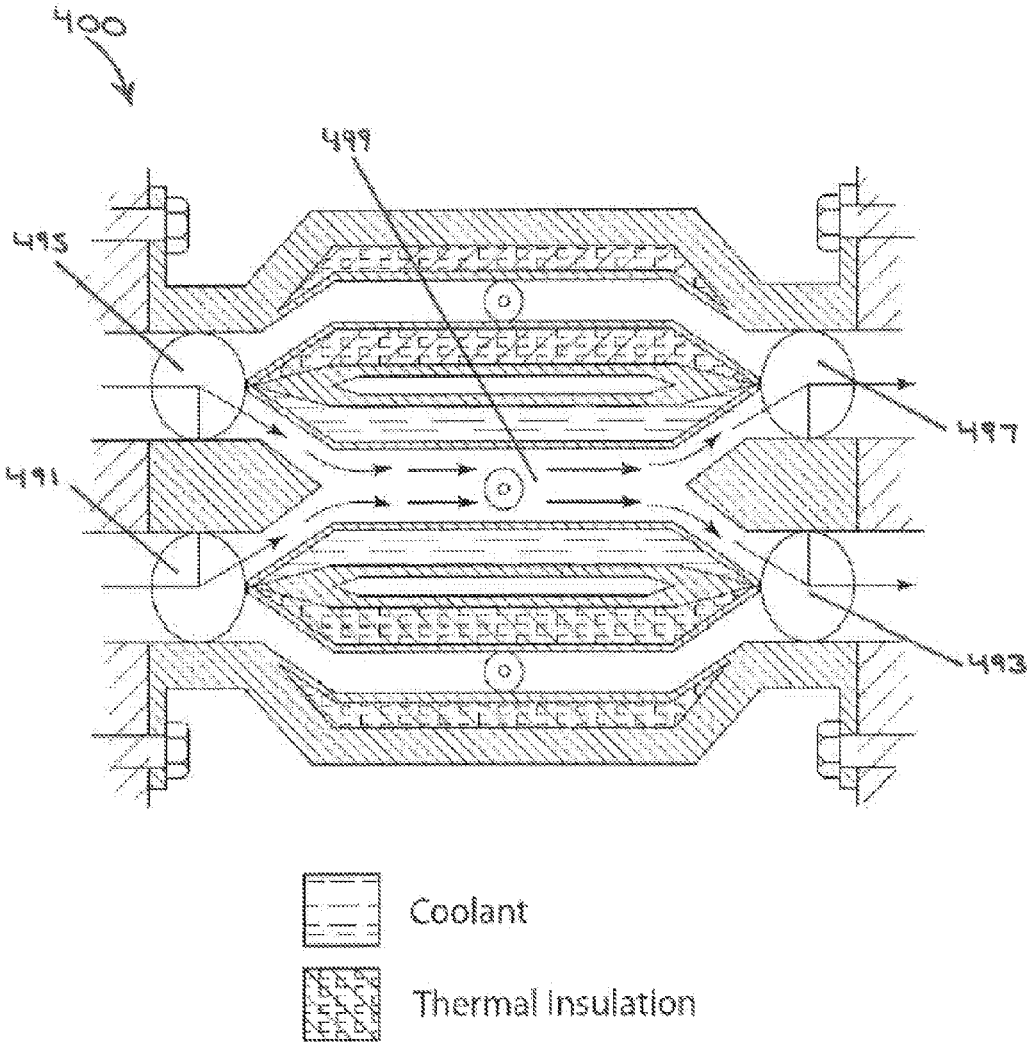
FIG. 13 is a schematic cross-sectional view of the crossover manifold of the engine of FIG. 11 with the set of control valves in a second configuration.

In operation, the engine 400 operates in substantially the same way as the engine 300 described above. During low load and/or low speed operation, or during engine start-up/warm-up, a series of valves 491, 493, 495, 497 are configured as shown in FIG. 12 to direct fluid from the compression cylinder through the insulated crossover passages 480, 484 to insulate or heat the fluid before it enters the expansion cylinder. During high load and/or high speed operation, the valves 491, 493, 495, 497 are configured as shown in FIG. 13 to direct fluid from the compression cylinder through the central, cooled crossover passage 499, thereby cooling the fluid before it enters the expansion cylinder.

The engines 200, 200', 300, 400 disclosed herein are configured to operate reliably over a broad range of engine speeds. In certain embodiments, engines according to the present invention are capable of operating up to a speed of at least about 4000 rpm, and preferably at least about 5000 rpm, and more preferably at least about 7000 rpm.

Although the invention has been described by reference to specific embodiments, it should be understood that numerous changes may be made within the spirit and scope of the inventive concepts described. For example, one or more of the crossover valves or the air reservoir valves can be inwardly-opening. There can also be more than four crossover valves, and more than two crossover passages. In addition, the engines disclosed herein need not necessarily be air hybrid engines, but rather the V-shaped configuration can be applied to non-hybrid split-cycle engines as well. These changes are only exemplary, and other changes may be made without departing from the scope of the invention. Accordingly, it is intended that the invention not be limited to the described embodiments, but that it have the full scope defined by the language of the following claims.

What is claimed is:

1. A split-cycle engine comprising:

a first cylinder head coupled to a compression cylinder;

a second cylinder head coupled to an expansion cylinder;

a manifold configured to selectively transfer fluid between the first and second cylinder heads, the manifold including independent insulated and cooled crossover passages;

a first valve having a position in which the first cylinder head is in fluid communication with the insulated crossover in which the first cylinder head is in fluid communication with the cooled crossover passage; and a second valve having position in which the second cylinder head is in fluid communication with the insulated crossover passage and a position in which the second cylinder head is in fluid communication with the cooled crossover passage.

2. The engine of claim 1, wherein the first and second valves are configured to selectively divert fluid through either the cooled crossover passage or the insulated crossover passage depending on an operating condition of the engine.

3. The engine of claim 1, further comprising one or more fluid jackets through which engine coolant flows, the one or more fluid jackets being disposed in proximity to the cooled crossover passage.

4. The engine of claim 1, further comprising an insulative material disposed around the insulated crossover passage.

5. The engine of claim 4, wherein the insulative material is a ceramic.

6. The engine of claim 1, wherein the at least one insulated crossover passage is heated.

7. A V-shaped split-cycle engine comprising:

a crankshaft that rotates about a crankshaft axis;

a compression cylinder having a centerline that intersects an offset axis, the offset axis being parallel to the crankshaft axis and offset therefrom; and an expansion cylinder having a centerline that intersects the offset axis;

wherein the centerline of the compression cylinder is positioned at a non-zero angle with respect to the centerline of the expansion cylinder; and wherein the offset axis is located opposite the compression cylinder and the expansion cylinder relative to the crankshaft axis.

8. The engine of claim 7, wherein the engine is an air hybrid engine.

9. The engine of claim 7, wherein the non-zero angle is in a range of about 10 degrees to about 120 degrees.

10. The engine of claim 7, wherein the non-zero angle is selected from the group consisting of about 30 degrees, about 45 degrees, and about 60 degrees.

11. The engine of claim 7, further comprising:

a first cylinder head coupled to the compression cylinder;

a second cylinder head coupled to the expansion cylinder; and at least one crossover passage formed externally to the first and second cylinder heads and configured to selectively transfer fluid between the first and second cylinder heads.

12. The engine of claim 11, wherein the engine is an air hybrid engine and the at least one crossover passage includes an air reservoir valve for selectively placing an air reservoir in fluid communication with the first or second cylinder heads.

13. The engine of claim 11, wherein the at least one crossover passage comprises first and second crossover passages, each having an associated crossover compression valve and a crossover expansion valve.

14. The engine of claim 13, wherein the crossover compression valves and the crossover expansion valves are outwardly opening.

15. The engine of claim 12, wherein the air reservoir valve is outwardly opening.

* * * * *

UNITED STATES PATENT AND TRADEMARK OFFICE

CERTIFICATE OF CORRECTION

PATENT NO. : 8,714,121 B2
APPLICATION NO. : 13/248059
DATED : May 6, 2014
INVENTOR(S) : Ford Allen Phillips et al.

It is certified that error appears in the above-identified patent and that said Letters Patent is hereby corrected as shown below:

In the Claims:

Column 15, Claim 1, line 47: insert --passage and a position-- between “crossover” and “in which”

Signed and Sealed this
Eighth Day of July, 2014

Michelle K. Lee

Michelle K. Lee
*Deputy Director of the United States Patent and Trademark Office*